US007033235B1

(12) United States Patent
Slimi

(10) Patent No.: US 7,033,235 B1
(45) Date of Patent: Apr. 25, 2006

(54) PERSONAL WATER EQUIPMENT EXTENDING THE HAND, AND DEVICES DESIGNED TO RECEIVE SUCH EQUIPMENT

(76) Inventor: Ali Slimi, 181 Rue de Boissise, Vosves, Dammarie-les-Lys (FR) 77190

( * ) Notice: Subject to any disclaimer, the term of this patent is extended or adjusted under 35 U.S.C. 154(b) by 0 days.

(21) Appl. No.: 11/066,444

(22) Filed: Feb. 28, 2005

(51) Int. Cl.
*A63B 31/10* (2006.01)

(52) U.S. Cl. ..... 441/56; 441/88
(58) Field of Classification Search ..... 441/55, 441/56, 88
See application file for complete search history.

(56) References Cited

U.S. PATENT DOCUMENTS 3,789,447 A 2/1974 Lavallee
5,800,229 A 9/1998 Peterson

FOREIGN PATENT DOCUMENTS

DE 1 085 445 7/1960
FR 2 822 074 9/2002

*Primary Examiner*—Jesus D. Sotelo
(74) *Attorney, Agent, or Firm*—Young & Thompson

(57) ABSTRACT

Personal water equipment (1) designed to extend a user's hand (M), comprising an upper surface with a zone for receiving a user's fingers, comprising means of holding a user's fingers, a zone for receiving said user's palm comprising means of holding the user's palm, these holding means (4.1, 4.2) extending on either side of the upper surface, approximately above the latter so as to provide a space for inserting the user's hand (M).

This personal water equipment (1) is coupled with flotation means (10) to which said personal water equipment is removably fastened by fastening means arranged such that the upper surface of the personal water equipment is in contact with the flotation means.

Use in particular in water activities such as swimming, diving, surfing and in lifesaving.

8 Claims, 5 Drawing Sheets

PERSONAL WATER EQUIPMENT EXTENDING THE HAND, AND DEVICES DESIGNED TO RECEIVE SUCH EQUIPMENT

This invention relates to a personal water equipment extending the hand, which can be used by a swimmer or user of a boat or water craft. It also relates to devices designed to receive this accessory and a suitable carrying device.

From the document FR2822074 in the name of the present applicant, a personal water equipment designed to extend a user's hand, of the hand paddle type, is already known, comprising an upper surface with a zone for receiving a user's fingers comprising means of holding said user's fingers, a zone for receiving said user's palm comprising means of holding said user's palm, these holding means extending on either side of said upper surface approximately above said upper surface so as to provide a space for inserting said user's hand. The finger-holding means comprise one or more finger studs, arranged to partially cover a user's finger.

This is an efficient and ergonomic personal water equipment making it possible to considerably improve swimmers' performance in terms of speed and endurance. The fact that the hand is held inside the personal water equipment relieves the swimmer of the forces exerted by the water on his finger joints. Moreover, the holding characteristics of this personal water equipment make it particularly easy to use since neither the insertion of the hand nor its withdrawal requires any particular effort or stress, unlike rubber paddles.

The object of this invention is to propose an improvement to this concept, making it possible to further enhance performance, in particular for its use in water aerobics (aquaerobics). A further object is to obtain more efficient and safer use of the personal water equipment in a nautical environment that can sometimes be rough and dangerous.

This objective is achieved with a personal water equipment designed to extend a user's hand, comprising an upper surface with a zone for receiving a user's fingers comprising means of holding said user's fingers, a zone for receiving said user's palm comprising means of holding said user's palm, these holding means extending on either side of said upper surface approximately above said upper surface so as to provide a space for inserting said user's hand.

According to the invention, this equipment is coupled with flotation means on which said personal water equipment is removably fastened by fastening means arranged such that the lower surface of said personal water equipment is in contact with said flotation means.

Thus a personal water equipment of the hand paddle type is provided, having flotation characteristics that provide a swimmer, equipped with this accessory on each of his hands, with significant resistance to the penetration and movements of his arms in the water. This helps to increase the effectiveness of swimming exercises and water aerobics. Personal water equipments according to the invention can also be advantageously used for functional reeducation exercises.

Moreover, another advantage brought to users of hand paddles according to the invention is a particularly useful functionality consisting of being able to have their paddles at their disposal, in complete safety and comfort, without the risk of losing them by sinking during the hand insertion and removal operations. Moreover, the paddles according to the invention can also be used as safety equipment as, thus equipped with floats, they constitute an effective flotation means for their user. Many other advantageous applications of the paddles according to the invention can be envisaged.

In a first embodiment of the invention, the flotation means comprise a floating basic structure comprising, on one of its surfaces with dimensions appreciably greater than those of the personal water equipment, a recess designed to receive the lower surface of said personal water equipment and means of holding said personal water equipment fastened removably to said floating basic structure.

In an advantageous embodiment the receiving recess comprises, at a first end, a hollow designed to receive the front end of said personal water equipment, and at a second end, a locking/unlocking device.

In a second embodiment of the invention, the flotation means are made up of the flotation elements of a life jacket adapted to receive removably one or two personal water equipments according to the invention.

In a third embodiment of the invention, the flotation means are made up of the flotation elements of a water sports board such as a surfboard or windsurfing board, provided with means of receiving and fastening one or two personal water equipments in a removable manner.

Other advantages and characteristics of the invention will become apparent on examination of the detailed description of an embodiment that is not at all limitative, and the attached drawings in which.

Figure 1:
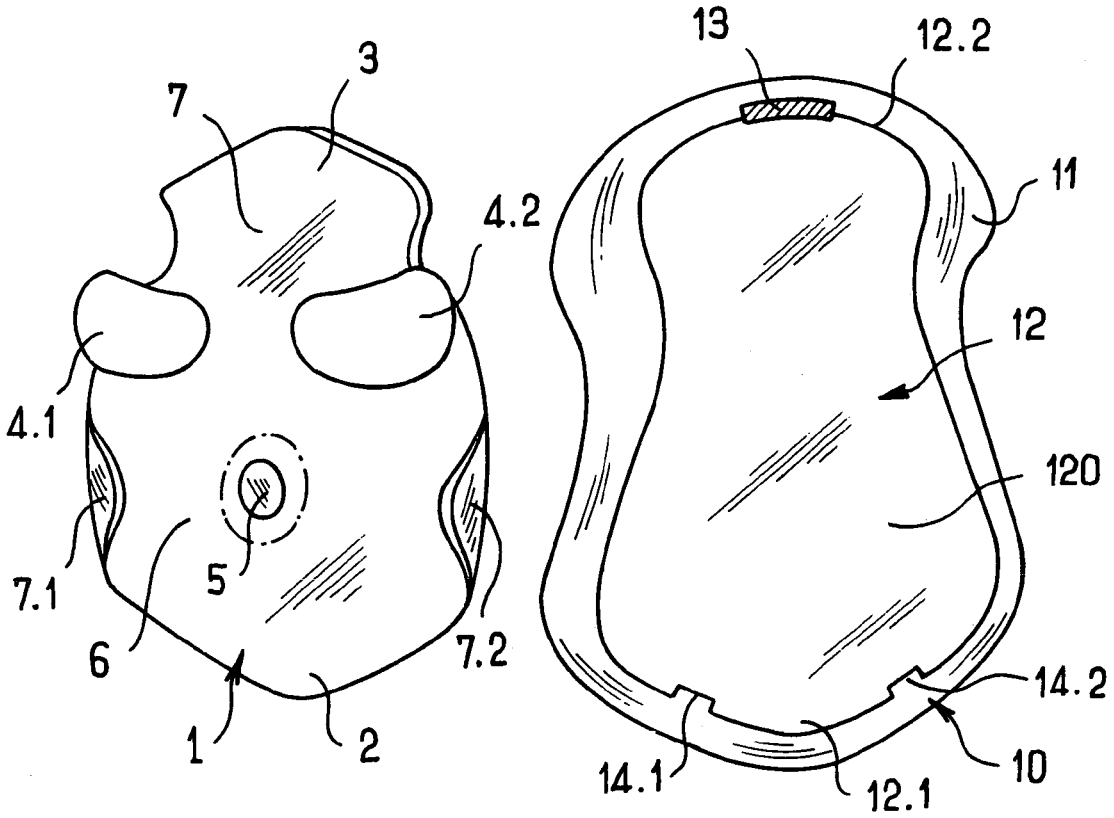
FIG. 1 illustrates a first embodiment of a personal water equipment and a flotation structure according to the invention in an uncoupled state.
Figure 4:
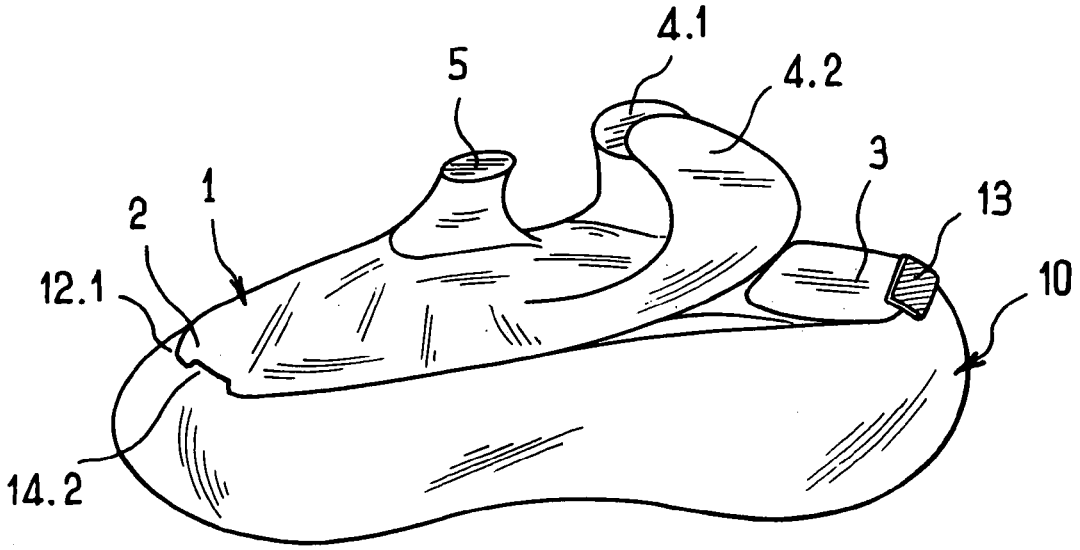
FIG. 4 is a perspective side view of the personal water equipment in FIGS. 2 and 3.
Figure 2:
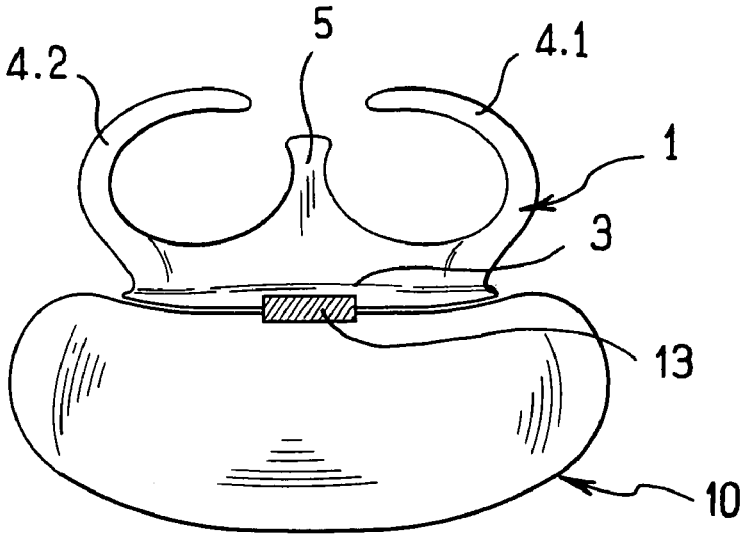
FIG. 2 is a rear view of the personal water equipment in FIG. 1 in a coupled state with a flotation structure.
Figure 3:
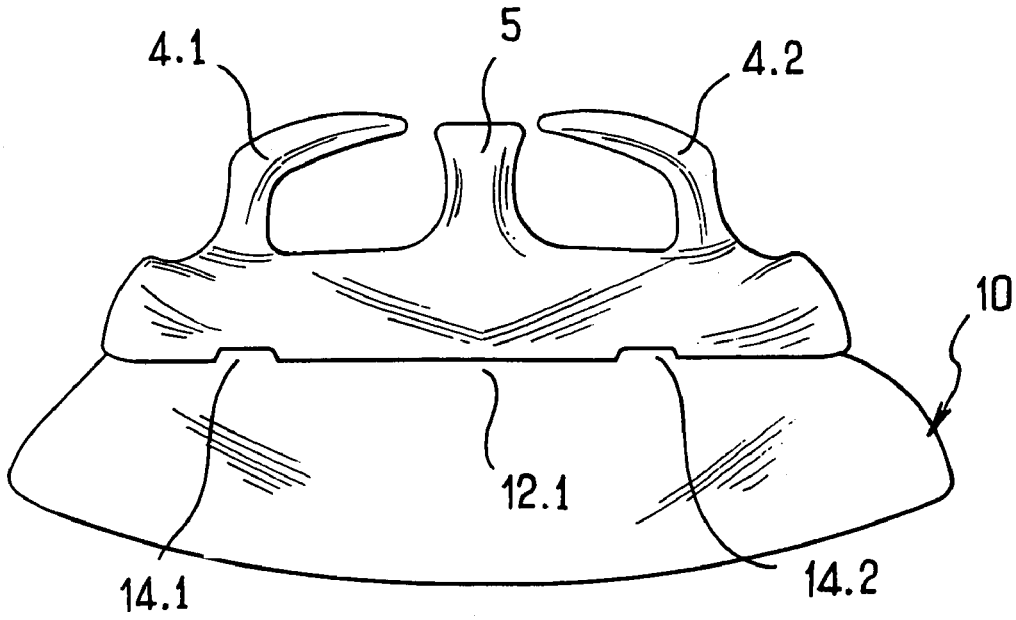
FIG. 3 is a rear view of the personal water equipment in FIG. 2.
Figure 5:
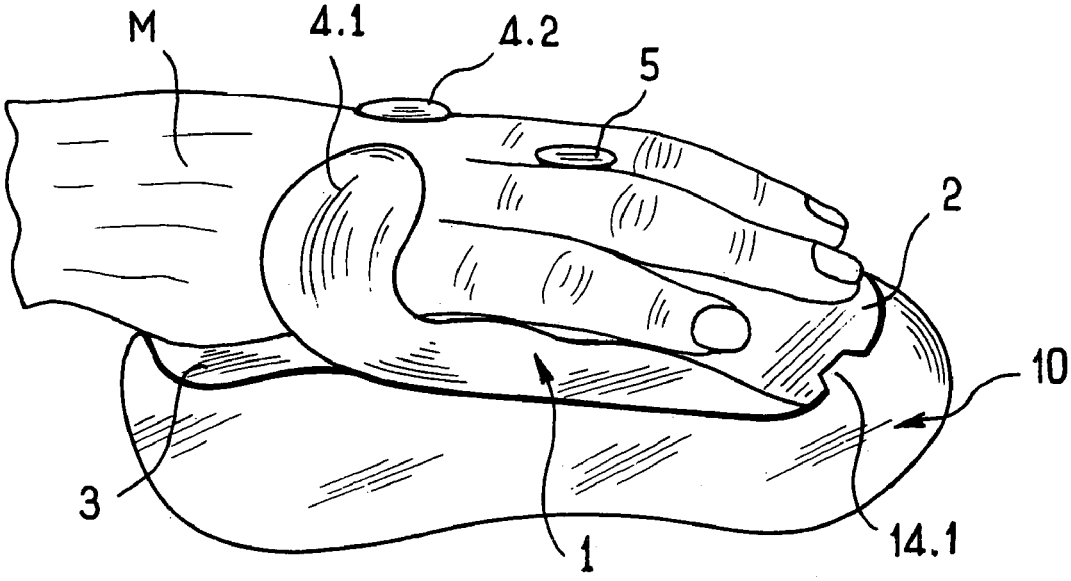
FIG. 5 illustrates a use of the personal water equipment in FIGS. 2 to 4.
Figure 6:
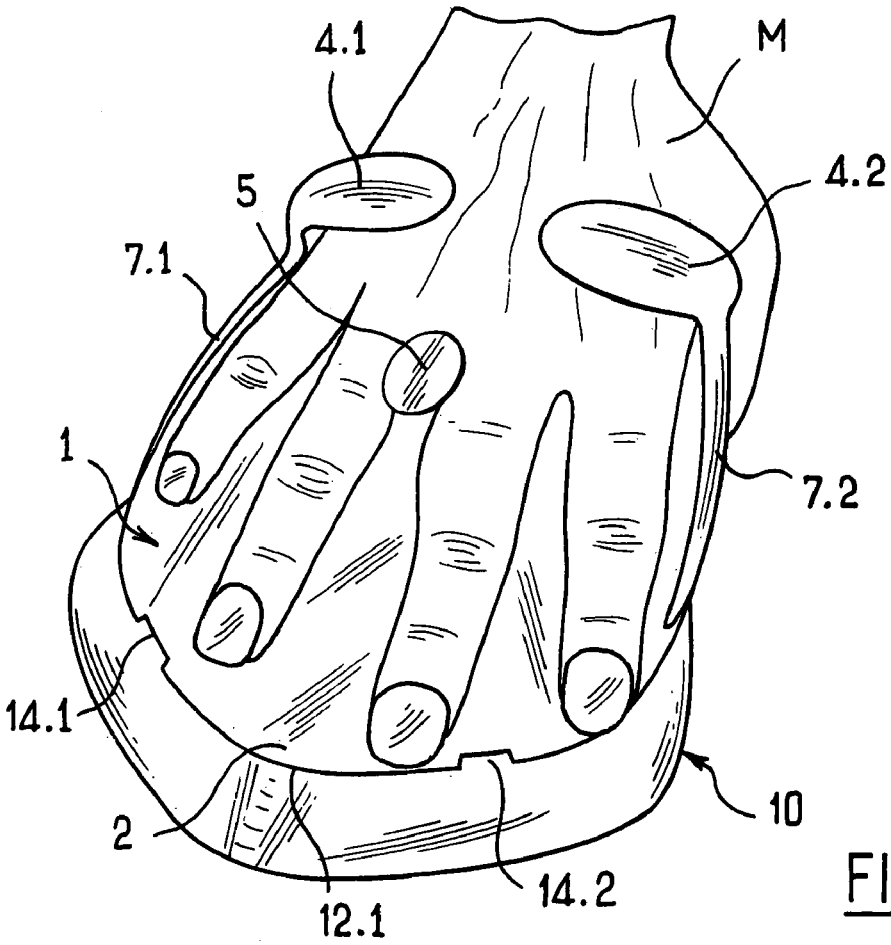
FIG. 6 is another illustration of the use shown in FIG. 5.

With reference to FIGS. 1 to 6, a first embodiment of a personal water equipment according to the invention, as well as its use, will now be described.

The personal water equipment 1 according to the invention, which can also be designated by the term paddle, comprises an appreciably streamlined structure designed to receive and mould to the inside of a hand M, comprising on its upper surface 6 a stud 5 designed to ensure the holding and guiding of two fingers of a user's hand and two approximately curved pieces 4.1, 4.2, each extending from one edge of the receiving structure, and designed to hold the user's hand such that his palm remains in contact with a zone 7 of the receiving structure. The paddle 1 according to the invention can also be provided with two fins 4.1, 4.2 arranged to hold the user's hand laterally. The paddle according to the invention can be made from a semi-rigid or flexible plastic material, for example by moulding or injection techniques. Its outer surface can be decorated and used for advertising, artistic or information purposes.

It must be noted that the paddle according to the invention can equally comprise on its upper part several finger studs, for example three, in order to guide and hold the fingers of a user's hand.

The flotation structure 10, made from an appropriate low-density material such as polystyrene or any other material with equivalent or superior characteristics, comprises a recess 12 made in the upper surface of the structure 10 and specifically arranged for receiving the paddle 1. The flotation structure 10 comprises on its front part 12.1 stops 14.1, 14.2 designed to ensure that the front part 2 of the paddle 1 is held firmly against a front part 12.1 of the flotation structure, and a locking/unlocking mechanism 13 of the paddle 1 in the receiving recess 12. This mechanism can be made in very simple manner by referring to the conventional techniques in this field. The base 120 of the receiving recess is designed to mould as closely as possible to the shape of the lower surface of the paddle 1 in order to avoid any penetration of water between the two components.

Figure 7:
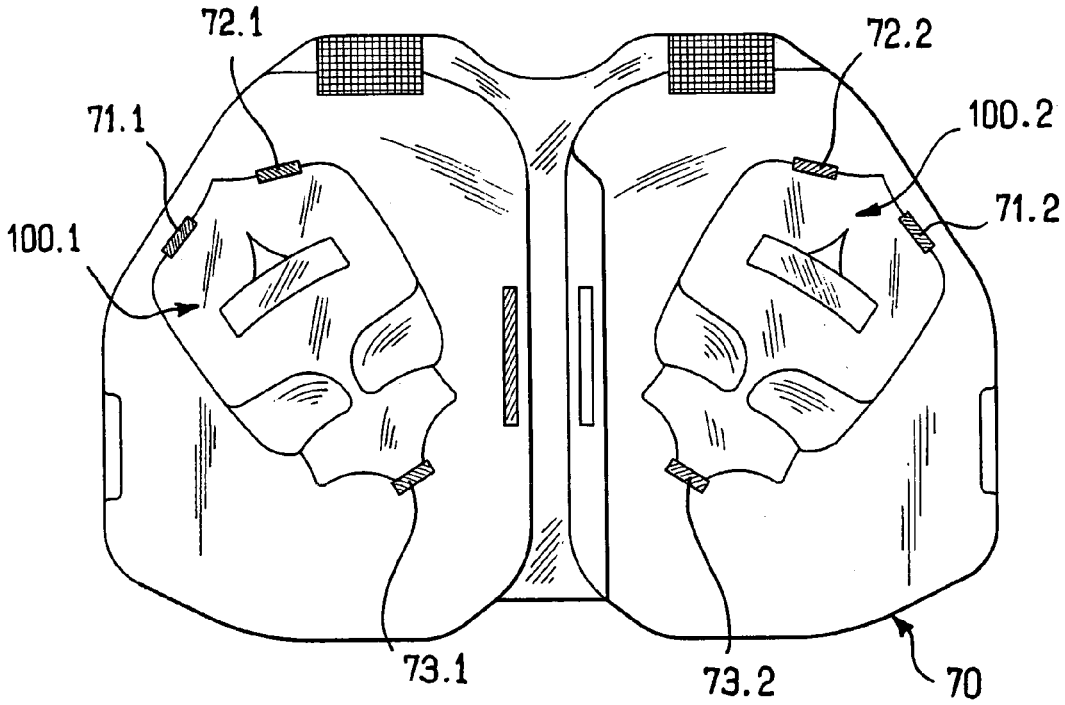
FIG. 7 illustrates a life jacket according to the invention, equipped with two personal water equipments-according to the invention.

In another form of the invention, two paddles 100.1, 100.2 according to the invention are fastened onto the two panels of a life jacket 70, as illustrated in FIG. 7. In this embodiment, it is the flotation elements normally inserted into the life jacket that cooperate with the paddles according to the invention. This life jacket is equipped with removable fastening devices 71.1, 72.1, 73.1; 71.2, 72.2, 73.2, for example Velcro®-type fastening systems, or another appropriate fastening system, making it possible to fasten the two paddles to the life jacket. A particular configuration can also be envisaged in which the two paddles are fastened permanently to the life jacket. Such a life jacket can allow rescuers to act efficiently on shipwreck victims, as a rescuer then simply has to insert his hands into the paddles of the life jacket worn by a person needing assistance, in order to be able to move said person and take him or her to a safe place, in a much more efficient manner than with a conventional life jacket with no handholds.

Figure 8:
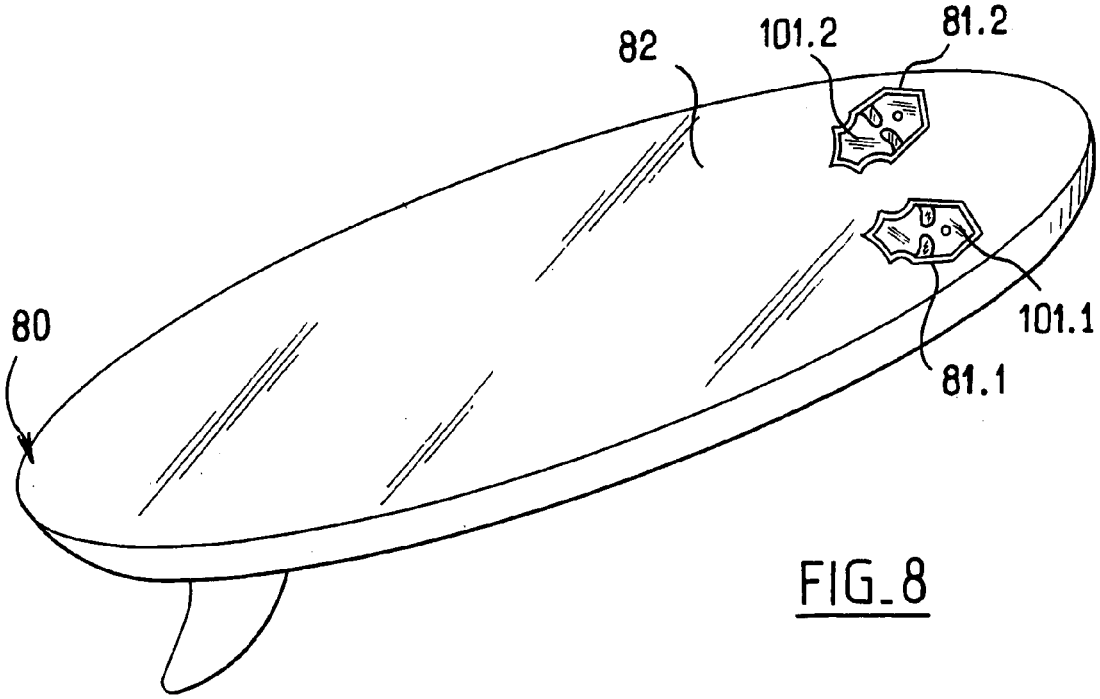
FIG. 8 illustrates a surfing type water sports board according to the invention, equipped with two personal water equipments according to the invention.

In another embodiment of the invention, the paddles 101.1, 101.2 according to the invention are removably fastened to the flotation structure of a surfboard 80, as illustrated in FIG. 8. The upper part 82 of this specifically adapted board is provided with two recesses 81.1, 81.2 designed to each receive a paddle according to the invention.

A user of such a surfboard can then use the two paddles as a propulsion component when for example he has to move against waves or rollers to get away from the shore. He simply has to remove the two paddles from their respective recesses, insert his two hands into these paddles and, lying on his board, use the two paddles as efficient extensions to his hands in order to move. It must be noted that these paddles could incidentally be used as weapons of defence against shark attack.

Figure 9:
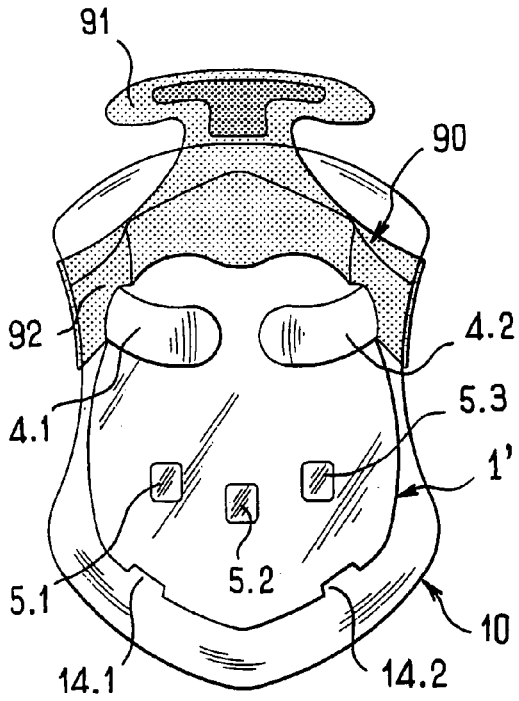
FIG. 9 is a top view of a second embodiment of a personal water equipment according to the invention, provided with a first adapted carrying system.
Figure 10:
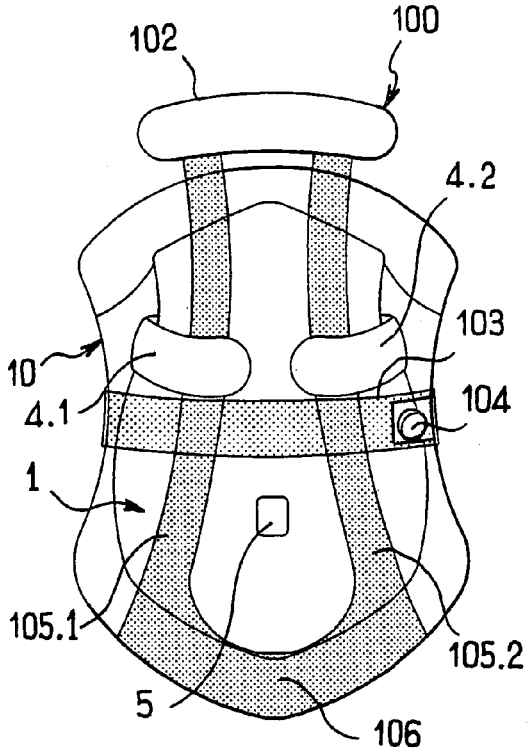
FIG. 10 is a top view of a personal water equipment according to the invention, provided with a second adapted carrying system.

It is possible to provide systems adapted for carrying paddle/float assemblies according to the invention, as illustrated in FIGS. 9 and 10. In the example in FIG. 9, a carrying device 90, provided with a handle 91, is used on a paddle 1 comprising three finger studs 5.1, 5.2, 5.3. This carrying device comprises a strap structure made from elastic material 92 with a Velcro®-type or pressure closing system designed to go round both the paddle 1' and the flotation structure 10. In the example in FIG. 10, the carrying device 100, also provided with a handle 102, comprises two strap structures.

Figure 11:
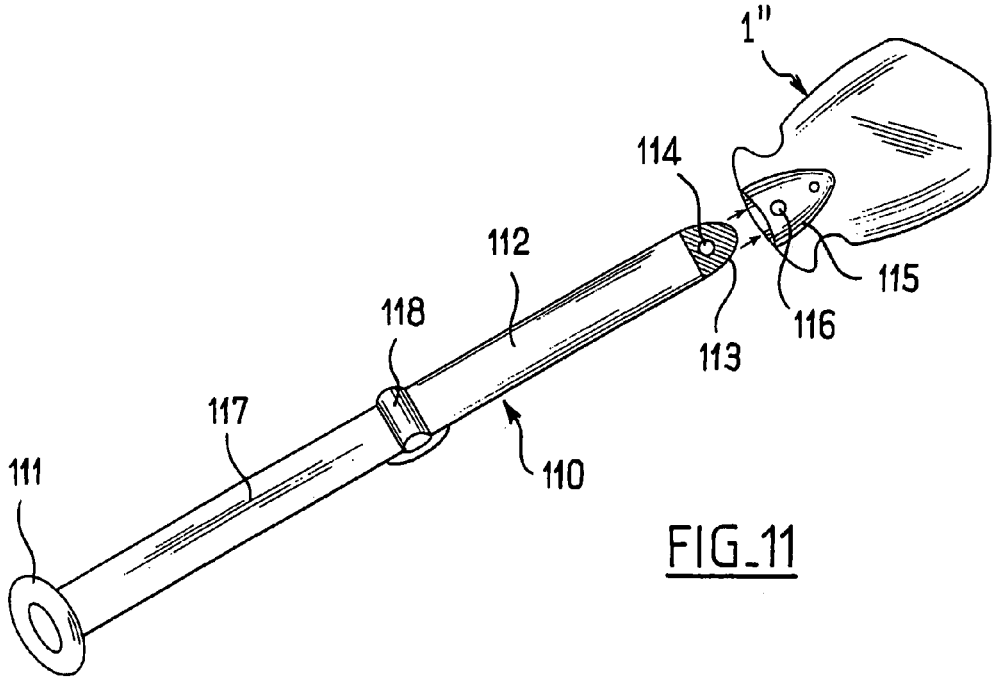
FIG. 11 illustrates a personal water equipment according to the invention adapted to receive a shaft so as to constitute an oar.

A paddle 1" according to the invention can also be equipped to receive a shaft and make a paddle or oar, as illustrated in FIG. 11. In this particular version of the invention, the paddle 1" comprises at its rear end a recess 115 adapted to receive one end 113 of a shaft 110 that is provided with a ball lock mechanism 114 designed to cooperate with a locking orifice 116 made in the receiving recess 115. This shaft 110 can comprise a handle 111 and be of a folding type in two parts 112, 117 with a locking mechanism 118.

Of course the invention is not limited to the examples just described and numerous adjustments can be made to these examples without exceeding the scope of the invention. In particular, it is possible to equip the paddles according to the invention with fastening devices, for example of "clip" type, in particular making it possible to attach a paddle to the user's belt.

The invention claimed is:

1. Personal water equipment (1.1, 1", 100.1, 100.2) designed to extend a user's hand, comprising an upper surface with a zone (6) for receiving a user's fingers and a zone (7) for receiving said user's palm, coupled with flotation means (10, 70, 80) to which said personal water equipment is removably fastened by fastening means (12) arranged such that the lower surface of said personal water equipment is in contact with said flotation means, characterized in that the zone (6) for receiving the fingers comprises means of holding said user's fingers, and in that the zone (7) for receiving the palm comprises means (4.1, 4.2) of holding said user's palm, these palm-holding means extending on either side of said upper surface approximately above said upper surface so as to provide a space for inserting said user's hand.

2. Personal water equipment (1) according to claim 1, characterized in that the flotation means comprise a floating basic structure (10) comprising, on one of its surface with dimensions appreciably greater than those of said personal water equipment (1), a recess (12) designed to receive the lower surface of said personal water equipment (1) and means (13, 14.1, 14.2) of holding said personal water equipment (1) fastened removably to said floating basic structure (10).

3. Personal water equipment (1) according to claim 2, characterized in that the receiving recess (12) comprises, at a first end (12.1) a zone (12.1) designed to receive the front end of said personal water equipment (1), and at a second end (12.2), a locking/unlocking device (13).

4. Personal water equipment (1,1') according to claim 3, characterized in that the means for holding comprises a stopping means (14.1, 14.2) for holding the front part of said personal water equipment (1,1') firmly against a front part of the receiving recess (12).

5. Personal water equipment (1,1') according to claim 2, characterized in that the means for holding comprises a stopping means (14.1, 14.2) for holding the front part of said personal water equipment (1,1') firmly against a front part of the receiving recess (12).

6. Personal water equipment (100.1, 100.2) according to claim 1, characterized in that the flotation means are made up of the flotation elements of a life jacket (70).

7. Personal water equipment (101.1, 101.2) according to claim 1, characterized in that the flotation means are made up of the flotation elements of a water sports board (80) such as a surfboard or windsurfing board.

8. Personal water equipment according to claim 1, characterized in that it further comprises fastening means designed in particular for attaching said accessory to a user's belt.

* * * * *